United States Patent [19]

Polito

[11] 4,119,291

[45] Oct. 10, 1978

[54] SEWER FORM

[76] Inventor: Joseph A. Polito, 398 Walnut St., Shrewsbury, Mass. 01545

[21] Appl. No.: 779,341

[22] Filed: Mar. 21, 1977

[51] Int. Cl.[2] ..... E03F 3/06

[52] U.S. Cl. ..... 249/11; 249/177; 249/184

[58] Field of Search ..... 249/1, 10–12, 249/142, 145, 149, 151, 152, 178, 184, 186, 177

[56] References Cited

U.S. PATENT DOCUMENTS

| | | | |
|---|---|---|---|
| 725,098 | 4/1903 | Learned | 249/11 |
| 788,581 | 5/1905 | Conger | 249/151 |
| 924,553 | 6/1909 | Irish | 249/151 |
| 2,681,494 | 6/1954 | Weber | 249/145 |
| 2,684,518 | 7/1954 | Whitlock | 249/177 |

*Primary Examiner*—Francis S. Husar
*Assistant Examiner*—John McQuade
*Attorney, Agent, or Firm*—Norman S. Blodgett; Gerry A. Blodgett

[57] ABSTRACT

Sewer form consisting of two telescoping sheet metal tubes whose outer ends are provided with conical portions adapted to engage pipe openings in a manhole, the form permitting the formation of an invert of concrete.

7 Claims, 13 Drawing Figures

SEWER FORM

BACKGROUND OF THE INVENTION

In the installation of a sewer system, it is necessary to lay the successive lengths of pipe in exact alignment with one another. When it is necessary to change the pipe to another direction, as would be true at a street intersection or at a bending in the street, a manhole is installed to allow the necessary change in direction. Not only does the manhole serve as a junction-piece, but it serves as an access means to permit clearing of the lengths of pipe by "rodding". The manhole is a fairly large concrete tubular element which is set vertically and which is provided with pipe holes adjacent its lower end adapted to receive the ends of the pipe. The sewage flows from an inlet pipe along an open groove (called an "invert") and flows into an exit pipe. In this way, a sewer maintenance man may climb down into the manhole and introduce a cleaning rod into either the inlet or the outlet pipe for the purpose of clearing accumulations or blockage. In the past, a manhole has been supplied to the contractor who is installing the sewer system in the form of a concrete tube having open lower end which during installation rests on the bottom of the trench. It has then been necessary for a worker to climb into the manhole and to build up a floor on the bottom of the manhole of brick and concrete. The floor is built up high enough to form the invert and also to provided sloping floor surfaces sloping down into the invert. This is a time consuming and labor-entensive operation. Furthermore, the resulting floor (particularly because of presence of the brick) tends to have an awkward appearance and there is a tendency for sewerage to catch loose or mislocated brick causing a blockage. Furthermore, because the operation takes such a long time, it is a time-limiting factor in the sewage installation project and, therefore, makes the project more expensive. These and other difficulties experienced with the prior art devices have been obviated in a novel manner by the present invention.

An outstanding object of the present invention is the provision of a sewer form which permits the formation in the field of a floor and invert in a manhole by pouring concrete. A further object of the present invention is the provision of a sewer form for forming an invert having any of the conventional number and direction of inlet and outlet branches.

It is another object of the instant invention to provide a sewer form which is simple in construction, which is inexpensive to manufacture, and which is capable of a long life of useful services with a minimum of maintenance.

A still further object of the invention is the provision of a sewer form which is light in weight and is easily carried from one place to another, as well as easily removed from the manhole after use.

It is a further object of the invention to provide a sewer form for forming an invert in a manhole, which form permits the invert to be constructed by unskilled labor.

It is a still further object of the present invention to provide a sewer from which permits a floor and invert to be constructed that is perfect in appearance and which is smooth enough to allow sewerage to flow unobstructedly through perfectly-formed inverts.

SUMMARY OF THE INVENTION

In general, the invention has to do with a sewer form for use in pouring concrete to form a floor with an invert in a manhole, the manhole having a tubular vertical wall formed with a plurality of pipe openings located at the same general horizontal level. The form is provided with a first thin-walled tube having a conical one end adapted to fit against another of the pipe openings and having the other end telescopingly fitted into the other end of the first tube.

More specifically, a third thin-walled tube is provided having a conical first end adapted to fit against one of the pipe openings and having the other end formed to fit tightly around the outer surface of the first tube with its axis lying at an acute angle to the axis of the first tube. Each tube consists of a semi-cylindrical lower wall, a flat upper wall, and two spaced, parallel flat side walls joining the upper wall to the lower wall.

DESCRIPTION OF THE PREFERRED EMBODIMENT

Figure 1:
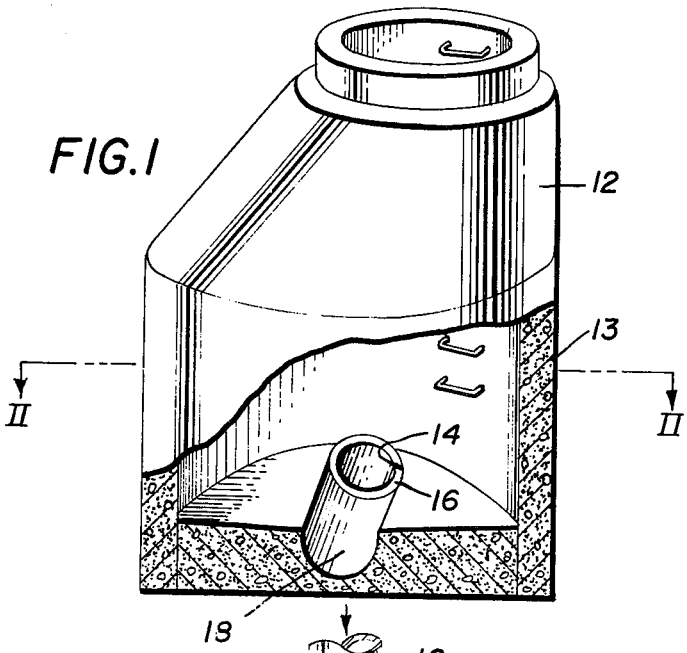
FIG. 1 is a perspective view, with portions broken away, showing a manhole with a floor and invert, as constructed by use of the present invention.
Figure 2:
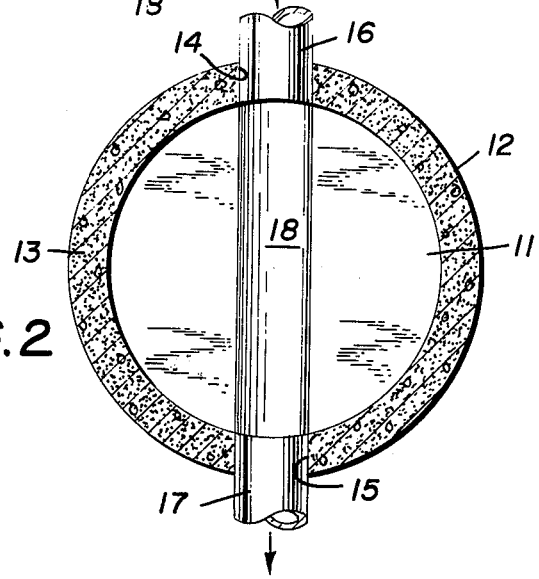
FIG. 2 is a horizontal sectional view of the manhole taken on line II—II of FIG. 1.

FIGS. 1 and 2 show the general arrangement of a manhole 12 having a tubular vertical wall 13 with a plurality of pipe openings 14 and 15 which retain the ends of an inlet pipe 16 and an outlet pipe 17, respectively. The manhole is provided with a concrete floor 11 the upper surface of which is provided with a groove or invert 18 of semi-circular form. As is evident in the drawing, the surface of the floor 11 slopes downwardly toward the invert 18.

Figure 3:
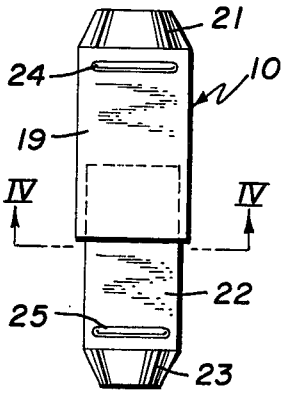
FIG. 3 is a plan view of a sewer form constructed in accordance with the principles of the present invention.

FIG. 3 shows the general features of a sewer form used in producing the floor 11 and invert 18 in the manhole. The sewer form, indicated generally by the reference numeral 10, is shown as having a first thin-walled tube 19, having a conical one end 21 which is adapted to fit snugly against the inner end of the pipe 16 in the pipe opening 14. It is also provided with a second thin-walled tube 22 having a conical one end 23 which is adapted to fit against the inner end of the pipe 17 in the pipe opening 15. The other end of the tube 22 is telescopingly fitted into the other end of the first tube 19. The second tube slides snugly within the first tube, so that they will remain in a selected fixed relative position with their conical one ends pressed tightly into their respected pipe openings. The tube 19 is provided with a handle 24 adajacent the conical one end 21, while the second tube 22 is provided with a similar handle 25 located adjacent the conical one end 23.

Figure 4:
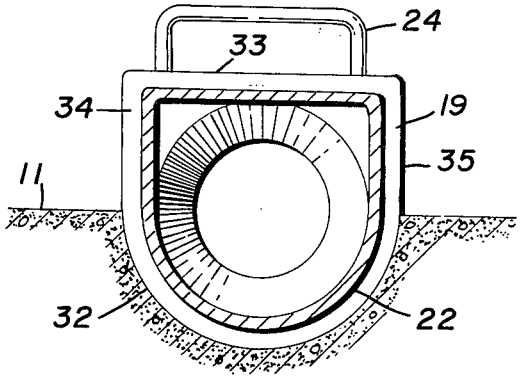
FIG. 4 is a vertical sectional view of the sewer form, taken on the line IV—IV of FIG. 3.

FIG. 4 shows the cross-sectional shapes of the tubes 19 and 22. The cross-sectional shape consists of a plane figure comprising a semi-circle from the ends of which tangentially extend two spaced, parallel straight lines whose upper ends are joined by a straight line that is perpendicular to both of them. The tube 19, for instance, consists of a semi-circular lower wall 32, a flat upper wall 33, and two spaced, parallel flat side walls 34 and 35 joining the upper wall to the lower wall. The tube 22 is similarly formed, but, of course, is slightly smaller to fit snugly within the tube 19.

Figure 5:
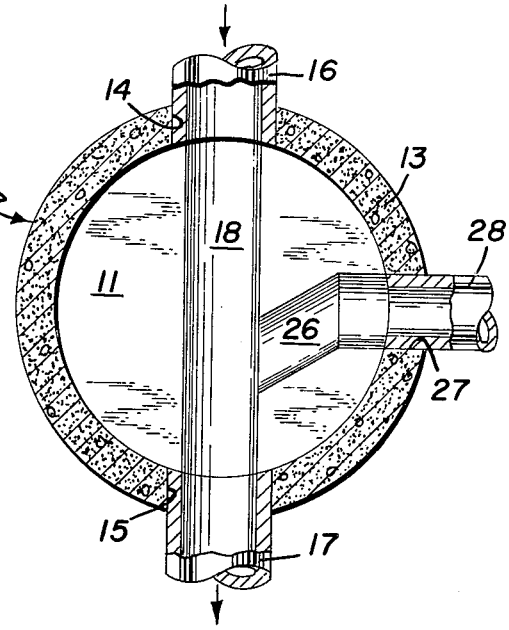
FIG. 5 is a horizontal sectional view of a manhole showing a different location of pipe openings and a different invert to serve them.

In FIG. 5 it can be seen that the manhole which is to be formed is provided with a floor 11 having an invert 18 which extends from the pipe 16 in the pipe opening 14 to the pipe 17 in the pipe opening 15. In addition, the wall 13 of the manhole is provided with a pipe opening 27 in which lies the end of an inlet pipe 28; an invert 26 extends from the pipe 28 to join the invert 18 at an acute angle.

Figure 6:
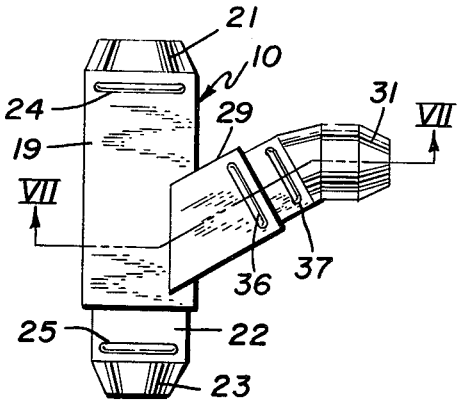
FIG. 6 is a plan view of the sewer from arranged to form the invert of FIG. 5.

FIG. 6 shows the manner in which a third thin-walled tube 29 is attached to the first tube 19 to provide the necessary form for pouring the concrete to provide the inverts 18 and 26 in FIG. 5. The third tube 29 is provided with a conical first end 31 which is adapted to fit against the pipe 28 in the pipe opening 27. The other end is formed to fit tightly around the outer surface of the first tube 19 with its center line or axis lying at an acute angle to the axis of the first tube; in the preferred embodiment this acute angle is 45°.

Figure 7:
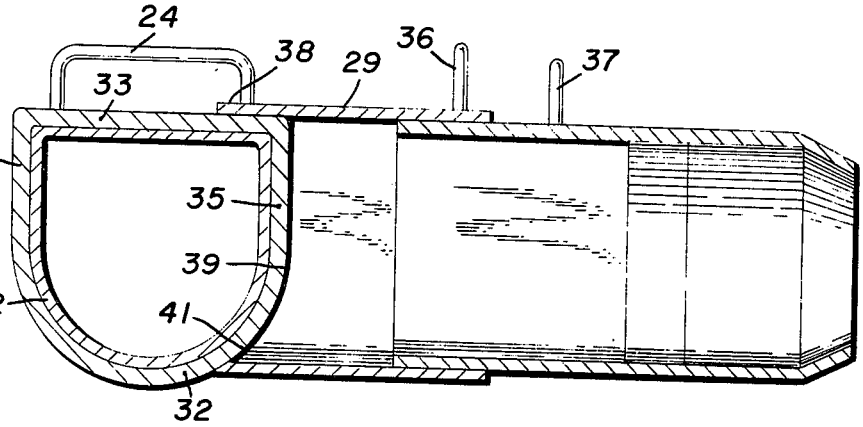
FIG. 7 is a sectional view of the sewer form taken on the line VII—VII of FIG. 6.

FIG. 7 shows the details of construction of the third tube 29. In general it is of the same cross-sectional shape as the first tube 19 and the second tube 22 and is formed in two telescoping portions, the first portion being attached to first tube 19 and having a handle 36 and the second portion being telescopingly mounted in the first portion and having a handle 37. In the preferred embodiment all of the tubes are formed of sheet steel. The first portion of the third tube 29 also has a lower edge 41 which is of a generally parabolic form so that it closely embraces the semi-cylindrical lower wall of the first tube 19. Lower edge 41 is in the form of the curve defined by the intersection of two circular cylinders of the same diameter and joins wall 35 at point 39. The second portion of tube 29 has the conical end 31 is bent to give a 135° angle, thus bringing its outer end around to 90° to the first tube 19.

The operation of the invention will now be readily understood in view of the above description. A manhole 12 is placed in the bottom of the trench, so that it is more-or-less self supporting in a vertical condition. The pipes 16 and 17 are inserted in the preformed pipe openings 14 and 15, respectively. The sewer form 10 is then inserted in place; if the manhole and invert are of the type shown in FIG. 2, only the first tube 19 and the second tube 22 are used. They are telescopingly collapsed, so that they can be inserted into the manhole and, when they are arranged generally horizontally between the pipe openings, they are extended until the conical one end 21 of the first tube 19 engages the pipe 16 and the conical one end 23 of the second tube 22 engages the pipe 17. By use of the handles 24 and 25, the telescoping tubes are pushed apart until they extend tightly between the two pipes. Concrete is then poured into the opening until the level is reached which is shown in FIG. 4, this generally speaking is at the uppermost part of the semi-cylindrical lower wall 32. As the concrete sets up, the contractor smooths the upper surface of the floor, so that it slopes slightly away from the sewer form 10 to provide proper drainage. Once the concrete has stiffened, it is possible to remove the sewer form 10 by grasping the handles 24 and 25 and pulling them together. It can then be removed from the manhole either in separate parts or as an assemblage, by using the handles 24 and 25.

After the removal of the sewer form, it may be necessary to do a little hand work to trim off the edges; otherwise the invert and the floor are completely formed and, after complete hardning of the concrete, are ready for use.

Figure 8:
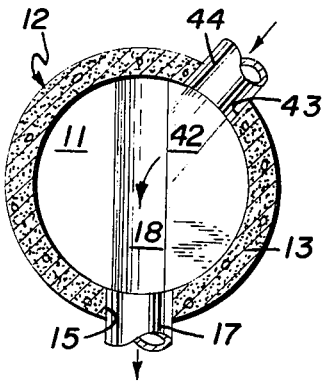
FIG. 8 is a horizontal sectional view of a manhole showing a still further arrangement of pipe openings and an invert to serve them.
Figure 9:
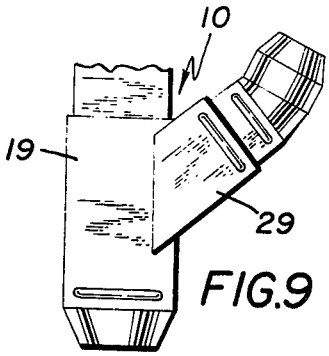
FIG. 9 is a plan view of the sewer form arranged to form the invert of FIG. 8.
Figure 10:
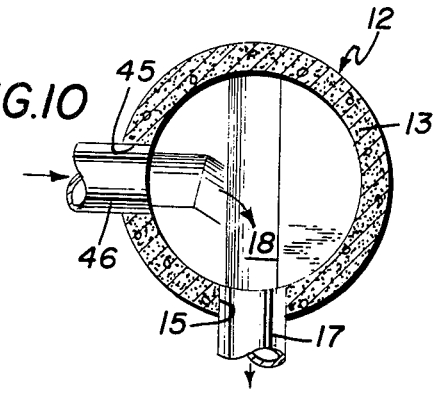
FIG. 10 is a horizontal sectional view of a manhole showing another arrangement of pipe openings and the invert to serve them.
Figure 11:
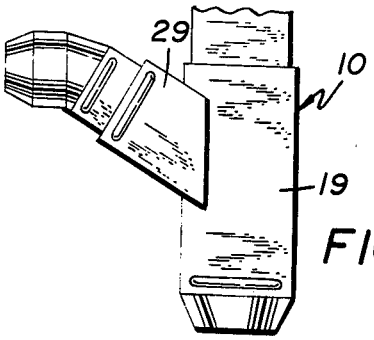
FIG. 11 is a plan view of the sewer form arranged to produce the invert shown in FIG. 10.
Figure 12:
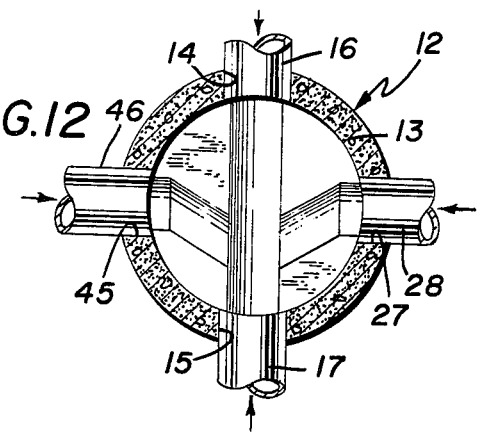
FIG. 12 is a horizontal sectional view of a manhole showing a still further arrangement of pipe openings and the invert to serve them.
Figure 13:
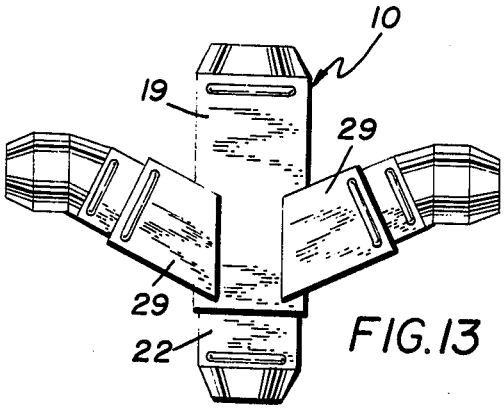
FIG. 13 is a plan view of the sewer form arranged to produce the invert of FIG. 12.

If the invert to be formed is similar to that shown in FIG. 5, it is, of course, necessary to use the third tube 29, but otherwise the operation is the same. The best practice would be to insert the tubes 19 and 22 between the pipes 16 and 17 in the manner described above and then to introduce the tube 29 in collapsed condition. After the conical one end 31 has been placed against the pipe 28, the other end is expanded to bring the extension 38 over the upper wall 33 of the first tube 19. Since the telescoping action is fairly snug, the parts will remain in extended condition during the pouring and treatment of the concrete. In FIG. 8, the manhole 13 is provided with two pipe openings 15 and 43 receiving, respectively, the outlet pipe 17 and an inlet pipe 44. The longitudinal axis of inlet pipe 44 is at an angle with to and intersects the longitudinal axis of outlet pipe 17. Openings 43 and 15 are more than 90 degrees apart. In this configuration, it is desired to form an invert 42 which extends from opening 43 and intersects invert 18 extending from pipe 17. When the arrangement shown in FIG. 8 is to be provided, the first tube 19 is reversed and is used with the third tube 29 is positioned as shown in FIG. 9 to produce the desired configuration. In FIG. 10 is shown a right angle turn in which the wall 13 of the manhole is provided with the outlet opening 15 receiving the pipe 17 and the pipe opening 45 receiving an inlet pipe 46. For this purpose, the first tube 19 is used with the third tube 29 but, as shown in FIG. 10, the inner telescoping second portion of the tube 29 is reversed from the condition shown in FIG. 9 to produce a suitable invert which intersects invert 18. In FIG. 12 a situation is shown where the manhole 13 is provided with four pipe openings 14, 15, 27 and 45 receiving, respectively, the inlet pipe 16, the outlet pipe 17, the inlet pipe 28, and the inlet pipe 46. For this purpose, as is shown in FIG. 13, the first and second tubes are used in conjunction with two of the third tubes 29.

The advantages of the present invention will now be readily understood from the description. It can be seen that with a few simple parts, namely, the first, second, and third tubes (and possibly a second version of the third tube) it is possible to provide all of the configurations necessary in forming inverts in manholes. The floor 11 thus formed gives a smooth standing place for the maintenance man who has to rod the pipes. The floor inclines smoothly toward the invert 18, the floor has no lumps and no rough areas, and there are no cracks or openings for the entry of water that can become frozen and break up the floor. The tubes 11, 22, and 29 are light in weight and can be disassembled to make them even lighter for carrying them up and down the manhole. It is only necessary, after use, to clean off the wet concrete and possibly to oil the surfaces from time-to-time to permit them to telescope smoothly and to allow easy removal from the formed floor of the manhole. Because they are made of sheet metal, they are light and easily maneuvered in and out of the manhole and they are also inexpensive for the same reason. Because of the smooth regular nature of the invert thus provided, the flow of sewage from the inlet pipes to the outlet pipes takes place without difficulty and there is little danger of accumulation of solids. The major advantage of the present construction is, however, the fact that the invert can be made quickly and easily by unskilled labor, so that a sewage constructions job can be completed in a much shorter period of time. There are no holdups while individual manholes are being completed. There is no need to bring brick to the site and it is only necessary to provide suitable mixed concrete and the usual mason's trowel for smoothing.

Also, despite any field changes, the apparatus will still produce perfect inverts. Such field changes are necessary because of the many unforeseen underground pipes that mean that the manholes must be moved. This means that the inlet and outlet pipe angles must be changed. This would be a serious problem if the inverts were manufactured at the concrete plant, but is easily taken care of with the present invention. Also, by use of a water-tight fitting on the ends of the apparatus, it is possible to repair damaged existing inverts by pouring concrete around the form while the sewage flow continues through the inside of the form while the concrete is installed and is able to set.

It is obvious that minor changes may be made in the form and construction of the invention without departing from the material spirit thereof. It is not, however, desired to confine the invention to the exact form herein shown and described, but it is desired to include all such as properly come within the scope claimed.

I claim:

1. Sewer form for use in pouring concrete to form a floor with an invert in a manhole, the manhole having a tubular vertical wall formed with a plurality of pipe openings located at the same general horizontal level, comprising:

(a) a first thin-walled tube having a conical one end adapted to fit against a first one of the pipe openings, (b) a second thin-walled tube having a conical one end adapted to fit against a second one of the pipe openings and having its other end telescopingly fitted into the other end of the first tube in a snug sliding fit, so that said first and second tubes are adapted to be arranged in fixed relative position with their respective conical ends pressed tightly into their respective pipe openings, and (c) a third thin walled tube having a first portion, one end of the first portion being attached to said first tube, so that its axis lies at an acute angle to the axis of the said first tube, and having a second portion which has a conical end adapted to fit against a third one of said pipe openings and which has its other end telescopingly fitted into the other end of said first portion in a snug sliding fit.

2. Sewer form as recited in claim 1, wherein said first portion includes an extension of its upper wall that rests on the upper wall of one of the first and second tubes.

3. Sewer form as recited in claim 1, wherein said first tube has a semi-cylindrical lower wall and said one end of said first portion has a lower edge which is in a generally parabolic form, so as to closely embrace the semi-cylindrical lower wall of the said first tube.

4. Sewer form as recited in claim 3, wherein the said lower edge is in the form of the curve formed by the intersection of two circular cylinders of the same diameter.

5. Sewer form as recited in claim 1, wherein all tubes are formed of sheet steel.

6. Sewer form as recited in claim 1, wherein each tube consists of a semi-cylindrical lower wall, a first upper wall and two spaced, parallel flat side walls joining the upper wall to the lower wall.

7. Sewer form as recited in claim 1, wherein each tube is provided with a handle extending upwardly from the upper portion thereof.

* * * * *